US007988253B2

(12) United States Patent
Komamiya et al.

(10) Patent No.: US 7,988,253 B2
(45) Date of Patent: Aug. 2, 2011

(54) INK JET PRINTING APPARATUS AND INK JET PRINTING METHOD

(75) Inventors: Eiji Komamiya, Kawasaki (JP); Yoshinori Nakajima, Yokohama (JP); Akihiro Tomida, Kawasaki (JP); Mitsutoshi Nagamura, Tokyo (JP); Akihiro Kakinuma, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 295 days.

(21) Appl. No.: 12/269,528

(22) Filed: Nov. 12, 2008

(65) Prior Publication Data

US 2009/0128595 A1 May 21, 2009

(30) Foreign Application Priority Data

Nov. 16, 2007 (JP) ..... 2007-298426

(51) Int. Cl.
*B41J 29/393* (2006.01)

(52) U.S. Cl. ..... 347/19; 347/41

(58) Field of Classification Search ..... 347/19, 347/41, 14, 30

See application file for complete search history.

(56) References Cited

U.S. PATENT DOCUMENTS

| | | | | |
|---|---|---|---|---|
| 6,695,432 | B2 * | 2/2004 | Kanda | 347/41 |
| 6,746,094 | B1 * | 6/2004 | Powell et al. | 347/19 |
| 2006/0279587 | A1 | 12/2006 | Furuichi et al. | |

FOREIGN PATENT DOCUMENTS

| | | | |
|---|---|---|---|
| JP | 10315444 | A | 12/1998 |
| JP | 2004181826 | A | 7/2004 |
| JP | 2005074759 | A | 3/2005 |
| JP | 2001310513 | A | 11/2008 |

* cited by examiner

*Primary Examiner* — Lamson D Nguyen

(74) *Attorney, Agent, or Firm* — Fitzpatrick, Cella, Harper & Scinto

(57) ABSTRACT

An object of the present invention is to provide an ink jet printing apparatus and an ink jet printing method which can inhibit degradation of image quality resulting from ink drying unevenness regardless of the type of ink and the amount of ejected ink. To accomplish the object, the present invention determines, based on print data, drying characteristics of ink applied by a print head to a predetermined time control area in an image forming area to be formed on a print medium. Based on the result of the determination, a wait time is controlled which is set between a preceding scan and a succeeding scan in a plurality of scans performed within the wait time control area.

9 Claims, 12 Drawing Sheets

| | WEIGHTING FACTOR |
|---|---|
| K | 1.0 |
| C | 1.2 |
| M | 1.2 |
| Y | 0.8 |
| R | 0.8 |
| G | 1.2 |
| B | 1.2 |
| Pc | 1.0 |
| Pm | 1.0 |
| Gy | 1.0 |
| Pgy | 1.0 |

FIG.8A

| | 6 PASSES | 12 PASSES | 16 PASSES |
|---|---|---|---|
| THRESHOLD VALUE k | 4200 | 2400 | 1800 |

FIG.8B

| INK COLOR USED FOR PATCH PRINTING | PRINT DUTY | | | | | | | | | |
|---|---|---|---|---|---|---|---|---|---|---|
| | 20 | 40 | 60 | 80 | 100 | 120 | 140 | 160 | 180 | 200 |
| K | ○ | ○ | ○ | ○ | ○ | △ | △ | × | × | × |
| C | ○ | ○ | ○ | ○ | △ | × | × | × | × | × |
| M | ○ | ○ | ○ | ○ | △ | △ | × | × | × | × |
| Y | ○ | ○ | ○ | ○ | ○ | ○ | ○ | ○ | ○ | ○ |
| R | ○ | ○ | ○ | ○ | ○ | ○ | ○ | ○ | ○ | ○ |
| G | ○ | ○ | ○ | △ | △ | × | × | × | × | × |
| B | ○ | ○ | ○ | ○ | △ | × | × | × | × | × |
| Pc | ○ | ○ | ○ | ○ | ○ | △ | × | × | × | × |
| Pm | ○ | ○ | ○ | ○ | ○ | △ | △ | × | × | × |
| Gy | ○ | ○ | ○ | ○ | ○ | △ | △ | × | × | × |
| Pgy | ○ | ○ | ○ | ○ | ○ | ○ | △ | △ | △ | × |

FIG.9

| AREA | SWITCHING POSITION (pixel) | WAIT TIME SETTING PATTERN (sec) | | | | | |
|---|---|---|---|---|---|---|---|
| | | A | B | C | D | E | F |
| Start | -1280 | 0 | 0 | 0 | 0 | 0 | 0 |
| T1 | -960 | 0 | 0.2 | 0.4 | 0.5 | 0.6 | 0.7 |
| T2 | -640 | 0 | 0.4 | 0.6 | 0.8 | 1 | 1.2 |
| T3 | -320 | 0 | 0.7 | 0.9 | 1.2 | 1.4 | 1.6 |
| T4 | 0 | 0 | 1 | 1.2 | 1.5 | 1.7 | 2 |
| T5 | 320 | 0 | 0.7 | 0.9 | 1.2 | 1.4 | 1.6 |
| T6 | 640 | 0 | 0.4 | 0.6 | 0.8 | 1 | 1.2 |
| T7 | 960 | 0 | 0.2 | 0.4 | 0.5 | 0.6 | 0.7 |
| T8 | 1280 | 0 | 0 | 0 | 0 | 0 | 0 |

FIG.10

| NUMBER OF TIMES THRESHOLD VALUE IS EXCEEDED $\alpha$ | SETTING PATTERN |
|---|---|
| 0 ~ 100 | A |
| 101 ~ 150 | B |
| 151 ~ 200 | C |
| 201 ~ 250 | D |
| 251 ~ 300 | E |
| AT LEAST 301 | F |

FIG.12

INK JET PRINTING APPARATUS AND INK JET PRINTING METHOD

BACKGROUND OF THE INVENTION

1. Field of the Invention

The present invention relates to an ink jet printing apparatus that performs a printing operation on a print medium while reciprocating a print head that ejects ink.

2. Description of the Related Art

An ink jet printing apparatus can print not only paper and OHP sheets but also various print media such as clothes, cardboards, earthenware, and metal. The ink jet printing apparatus can also print not only print media with flat print surfaces but also print media with protrusions and recesses, curved surface portions, edge portions. The ink jet printing apparatus can also inexpensively print high-quality color images by using a plurality of color inks and a print head that ejects the color inks. In particular, what is called a serial printing apparatus, which enables a reduction in the size and costs thereof, is commonly used; the serial printing apparatus reciprocates a print head along a width direction (main scanning direction) of the print medium, while intermittently conveying the print medium in synchronism with the main scanning.

Current ink jet printing apparatuses perform what is called marginless printing in which the entire print medium is printed without forming a non-printing area (blank) at edge portions of the print medium as is the case with silver halide photography. One method for achieving the marginless printing ejects ink to areas outside the print medium (Japanese Patent Laid-Open Nos. 2004-181826 and 10-315444). An alternative method prints an image on the print medium so as to leave non-printing areas at the edge portions of the print medium and then cuts the leading, trailing, right, and left edge portions of the print medium using a cutting mechanism, thus enabling the marginless printing (Patent Document 3).

The technique disclosed in Japanese Patent Laid-Open Nos. 2004-181826 and 10-315444 enables the marginless printing of standard print media. However, the method disclosed in Japanese Patent Laid-Open Nos. 2004-181826 and 10-315444 is inapplicable to a nonstandard printing apparatus, for example, a printing apparatus configured to print continuous roll paper and to cut the paper into print media using a cutting device provided in the printing apparatus.

In contrast, the technique disclosed in Japanese Patent Laid-Open No. 2001-310513 cuts the non-printing areas using the cutting mechanism provided in the printing apparatus. This eliminates the need for ejection of ink to a platen as required for Japanese Patent Laid-Open Nos. 2004-181826 and 10-315444, thus enabling the marginless printing without contaminating the platen.

In general, with a printing apparatus based on a serial scan method offering a function of cutting print media, if a cutting process is executed during printing, a carriage with the print head mounted thereon is stopped to prevent printing for a given time. If the cutting process is executed between the preceding print scan and the succeeding print scan, the time from completion of printing of an image for the preceding print scan until printing of an image for succeeding print scan is started increases by the time required for the cutting process. For example, in a 2 pass printing method, an image in a predetermined print area is completed by the preceding print scan and the succeeding print scan. Since the cutting process is executed between the preceding print scan and the succeeding print scan, the elapsed time between completion of the preceding print scan and the start of the succeeding print scan increases by the time required for the cutting. During the elapsed time, the ink in a portion of the print medium printed by the preceding print scan dries.

As described above, if the cutting process is executed between the preceding print scan and the succeeding print scan, the time from completion of the preceding print scan until the start of the succeeding print increases compared to a case in which the cutting operation is not performed. This results in a variation in the level of drying of the ink between the two cases. If the level of drying of the ink varies (drying unevenness), the corresponding print area offers a density and a color that are different from those of the other print areas. This may result in printing unevenness, thus degrading printing quality.

On the other hand, if the cutting process is executed when printing of one page is completed on the print medium, the ink drying unevenness as described above does not occur. However, the cutting device needs to be installed downstream of and relatively far from the print head in a conveying direction in order to cut the leading and trailing end portions of the print medium, particularly the leading end portion thereof after the printing of one page has been completed. This increases the size of the printing apparatus.

Thus, Japanese Patent Laid-Open No. 2005-074759 proposes a method of making the adverse effect of the drying unevenness on the printing quality insignificant instead of eliminating the drying unevenness resulting from the cutting process. That is, the time for which the carriage is stopped after each scan (this time is hereinafter referred to as wait time) is varied step by step before and after the cutting process, in order to make the adverse effect of the drying unevenness insignificant. Thus, the drying unevenness is allowed to occur step by step in predetermined ranges of print portions corresponding to the print scans before and after the cutting process, to make the adverse effect of the drying unevenness on the printing quality insignificant.

However, the technique disclosed in Japanese Patent Laid-Open No. 2005-074759 always varies the wait time step by step at a given rate regardless of the amount of ink ejected to the print medium, the type of the ink, and the like. Thus, sufficient printing quality or an appropriate print speed disadvantageously fails to be achieved depending on the type of the image to be printed or the ink used. That is, easiness with which the ink ejected to the print medium dries (this is hereinafter referred to as drying characteristics) varies depending on the type of the ink or the amount of ink applied to the print medium.

For example, if only a small mount of ink is applied to the print medium, the ink ejected to the print medium dries easily. If a large amount of ink is applied to the print medium, the ink is difficult to dry. However, the technique disclosed in Japanese Patent Laid-Open No. 2005-074759 varies the wait time step by step at the given rate. Thus, according to the technique disclosed in Japanese Patent Laid-Open No. 2005-074759, an excessively long wait time is set for images that dry relatively easily owing to the small amount of applied ink, disadvantageously reducing a print speed. In contrast, if a large amount of ink is applied, the wait time is insufficient, and the succeeding scan is performed in an insufficient dry condition. This prevents sufficient exertion of the effect based on the step-by-step variation of the wait time, that is, the effect of making the drying unevenness insignificant. Moreover, the drying characteristics of the ink ejected to the print medium also vary depending on the type of the ink, for example, the ink color. Thus, the technique in Japanese Patent Laid-Open No. 2005-074759 which varies the wait time step by step at the given rate may fail to achieve sufficient printing quality.

This printing quality problem is particularly profound in color printing apparatuses that overlappingly eject a plurality of color inks into the print medium.

In addition to the case of the above-described cutting process, printing is halted if a process of folding the trailing end portion of the print medium, a suction recovery process, or the like is executed. In this case, the drying unevenness may also occur to degrade image quality.

SUMMARY OF THE INVENTION

An object of the present invention is to provide an ink jet printing apparatus and an ink jet printing method which, even if a processing time is set for a print medium, can inhibit degradation of image quality resulting from ink drying unevenness regardless of the type of ink and the amount of ejected ink.

To accomplish the object, the present invention is configured as follows.

A first aspect of the present invention is an ink jet printing apparatus allowing a print head that ejects an ink droplet based on print data, to scan the same area of a print medium a plurality of times to print an image on the print medium, the apparatus comprising controller that controls wait time set between a preceding scan and a succeeding scan in a plurality of scans performed by the print head on a predetermined area comprising a plurality of the same areas, the controller controlling the wait time based on print data on the predetermined area.

A second aspect of the present invention is an ink jet printing method of allowing a print head that ejects an ink droplet based on print data, to scan the same area of a print medium a plurality of times to print an image on the print medium, the method comprising a control step of controlling wait time set between a preceding scan and a succeeding scan in a plurality of scans performed by the print head on a predetermined area comprising a plurality of the same areas, the control step controlling the wait time based on print data on the predetermined area.

In the present invention, the printing apparatus sets the wait time for marginless printing according to a condition in which the ink is applied to the print medium. Thus, possible printing unevenness resulting from the drying unevenness of an image can be inhibited. Furthermore, unwanted wait time between the scans can be reduced. As a result, image quality and print throughput can be improved.

Further features of the present invention will become apparent from the following description of exemplary embodiments (with reference to the attached drawings).

BRIEF DESCRIPTION OF THE DRAWINGS

FIG. 8A is a diagram showing an example of weighting factors set in association with a plurality of types of inks used in the present embodiment;

FIG. 8B is a diagram showing an example of a threshold value setting table according to which a threshold value k is set for each of plural types of passes;

FIG. 9 is a diagram showing results of evaluation of printing unevenness having occurred in the evaluation patch shown in FIG. 7;

FIG. 10 is a diagram showing a relationship between the number of times $\alpha$ that a sum for each determination area within the wait time control area exceeds the threshold value k and a wait time set depending on the number of times $\alpha$;

FIG. 12 is a table showing the relationship between the number of times $\alpha$ that the sum for each determination area within the wait time control area exceeds the threshold value k and a wait time setting pattern.

DESCRIPTION OF THE EMBODIMENTS

An embodiment of the present invention will be described below in detail with reference to the drawings.

Figure 1:
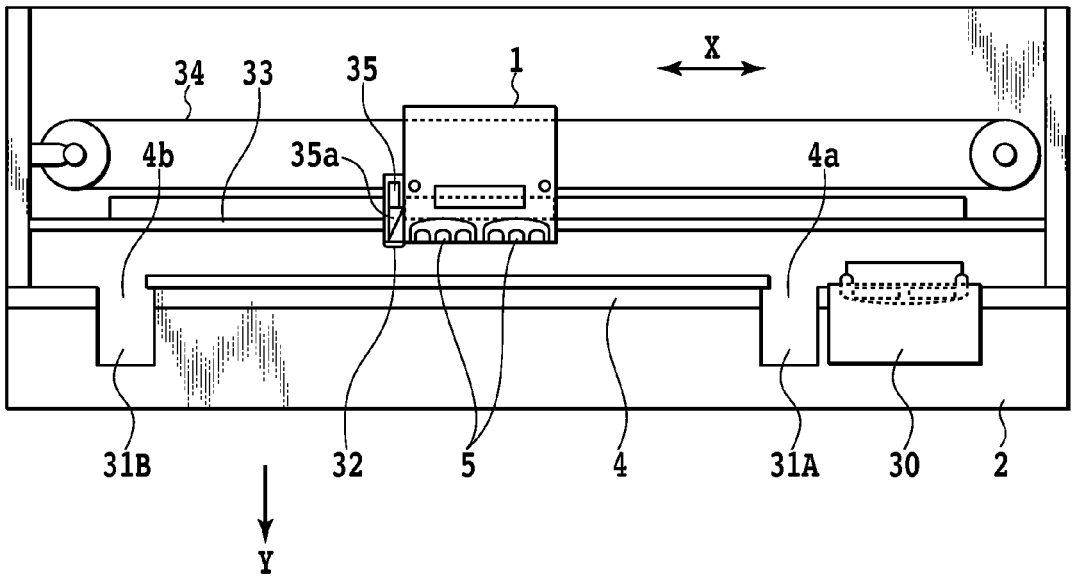
FIG. 1 is a elevational view showing an ink jet printing apparatus according to an embodiment of the present invention.

FIG. 1 is a plan view showing an ink jet printing apparatus (hereinafter simply referred to as a printing apparatus) according to the embodiment of the present invention. The ink jet printing apparatus according to the present invention prints relatively large-sized print media and includes a printing apparatus main body 2 with a conveying unit (not shown in the drawings) that conveys a print medium in a direction Y (conveying direction). The main body 2 includes a carriage 1 mounted so as to be movable along a guide shaft 33 in a main scanning direction shown by arrow X. The carriage 1 is configured so as to be reciprocatingly movable by means of a driving force transmitted by a carriage motor (not shown in the drawings) via a belt 34. A print head 5 that ejects ink droplets is mounted on the carriage 1. The print head 5 moves in a direction X together with the carriage 1. The carriage 1 also includes an optical sensor 32. The optical sensor 32 detects whether or not any print medium is present on a platen 4, while moving in a main scanning direction together with the carriage 1. Thus, the positions of opposite side ends of the print medium can be detected based on a detection output from the optical sensor 32. Moreover, the dimension (width dimension) of the print medium in the direction X can be determined based on the positions of the opposite side ends.

The carriage 1 includes a cutting unit 1 that cuts the print medium supported on the platen 4. The cutting unit 35 includes a knife 35*a* provided on a side of the carriage 1, and an actuator that raises and lowers the knife 35*a*. The knife 35*a* projected by the actuator can be inserted into a groove formed in the platen 4 so as to extend in the main scanning direction. The knife 35*a* placed in the groove is moved in the main scanning direction together with the carriage 1. By thus moving the knife 35*a* together with the carriage 1, the print medium supported on the platen 4 can be cut along the main scanning direction.

On the other hand, the print head 5 includes a plurality of nozzles through which ink is ejected. Each of the nozzles is made up of an ejection port through which the ink is ejected, and an ink channel communicating with the ejection port. An electrothermal converter is provided in the ink channel in each nozzle to locally heat the ink to cause film boiling so that resulting bubbling energy causes the ink to be ejected. A plurality of ejection ports are juxtaposed in an ejection surface of the print head in association with respective color inks used. Each ejection port row according to the present embodiment is composed of 1,280 ejection ports arranged at a density of 1,200 dpi along a sub-scanning direction that is a conveying direction of the print medium (the direction shown by arrow Y).

The color of inks used in the printing apparatus according to the present embodiment include black (K), three primary colors in subtractive color mixture, cyan (C), magenta (M), and yellow (Y), and light cyan (lc) and light magenta (lm) which are included in order to reduce a sense of granularity provided by a print image. The printing apparatus also uses gray (Gy) and pale gray (Pgy) inks in order to improve the gradation of gray lines, and R (red), G (green), and B (blue) inks in order to expand a maximum output gamut. The printing apparatus thus uses a total of eleven color inks to form color images.

The ink jet printing apparatus also includes print head recovery unit for maintaining the ejecting capability of each of the nozzles in the print head 5 in an appropriate condition. The recovery unit is composed of what is called a suction recovery mechanism 30 which covers the ejection ports, formed at tips of the nozzles in the print head 5, with a cap coupled to a pump and which allows the pump to generate a negative pressure inside the cap to force thickened ink and the like in each of the nozzles to be sucked and discharged.

In the ink jet printing apparatus configured as described above, the print medium is conveyed in the sub-scanning direction, shown by arrow Y, from the conveying unit (not shown in the drawings). The print head 5 receives a print signal from a print control section (not shown in the drawings) and moves in the main scanning direction, shown by arrow X, together with the carriage 1, while ejecting the ink to a print area of the print medium. Printing is performed by repeating the above-described printing operation and a conveying operation of conveying the print medium in the sub-scanning direction, shown by arrow Y, by a predetermined amount. That is, images are printed by allowing the print head to scan the print medium a plurality of times.

The printing apparatus according to the present embodiment performs marginless printing at the opposite side ends of the print medium by ejecting the ink to positions outside the opposite side ends according to image data larger than the print medium. The ink is thus ejected even onto the platen 4, positioned outside the print medium. Cutouts 4*a* and 4*b* are formed in the platen 4 outside the print medium. Ink receiving layers 31A and 31B are provided in lower parts of the cutouts 4*a* and 4*b*, respectively. Thus, even though the ink is ejected to areas outside the print medium, the platen 4 is prevented from being contaminated. The ink ejected to areas outside the print medium is received in the ink receiving layers.

On the other hand, like the opposite sides the print medium, a leading end portion and a trailing end portion of the print medium can be subjected to marginless printing by cutting the end portions using the cutting unit 35, provided on the carriage 1. That is, the leading end portion of the print medium with an image formed thereon is conveyed to and stopped at a position at a predetermined distance from a path along which the knife 35*a* of the cutting unit 35 moves. Then, the actuator of the cutting unit 35 projects the knife 35*a*. Then, the knife 35*a* moves in the main scanning direction X together with the carriage 1 to cut the leading end portion of the print medium supported on the platen 4, along the main scanning direction. Thus, the leading and trailing end portions of the print medium are also subjected to the marginless printing.

Figure 2:
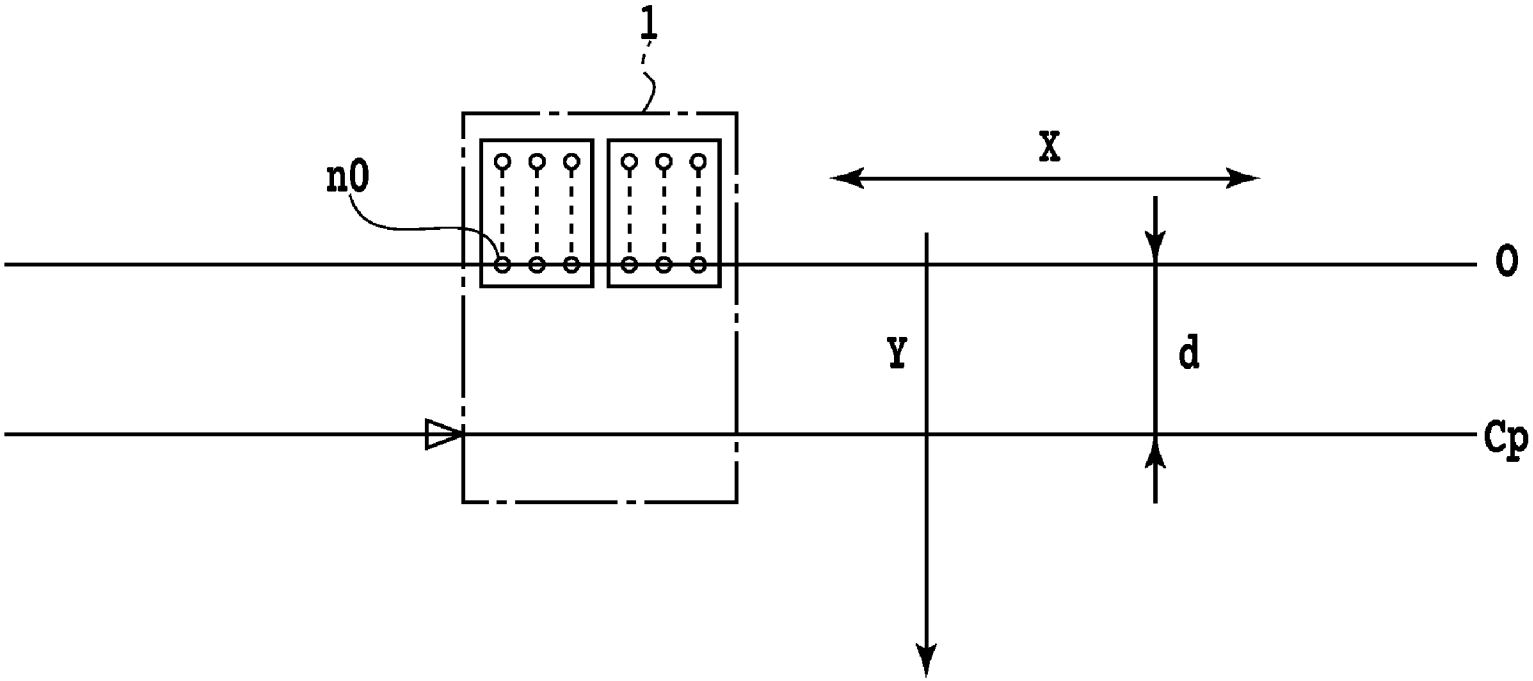
FIG. 2 is a plan view schematically showing a relationship between a print head and a cutting position on a print medium.

As shown in FIG. 2, the cutting position on the print medium, which corresponds to the moving path of the knife 35*a*, is set a distance d in front of (downstream of) the cutting position on the print head, in the conveying direction of the print medium (direction Y). While the carriage is moving during the cutting operation, an ink ejecting operation of the print head is stopped.

Figure 4:
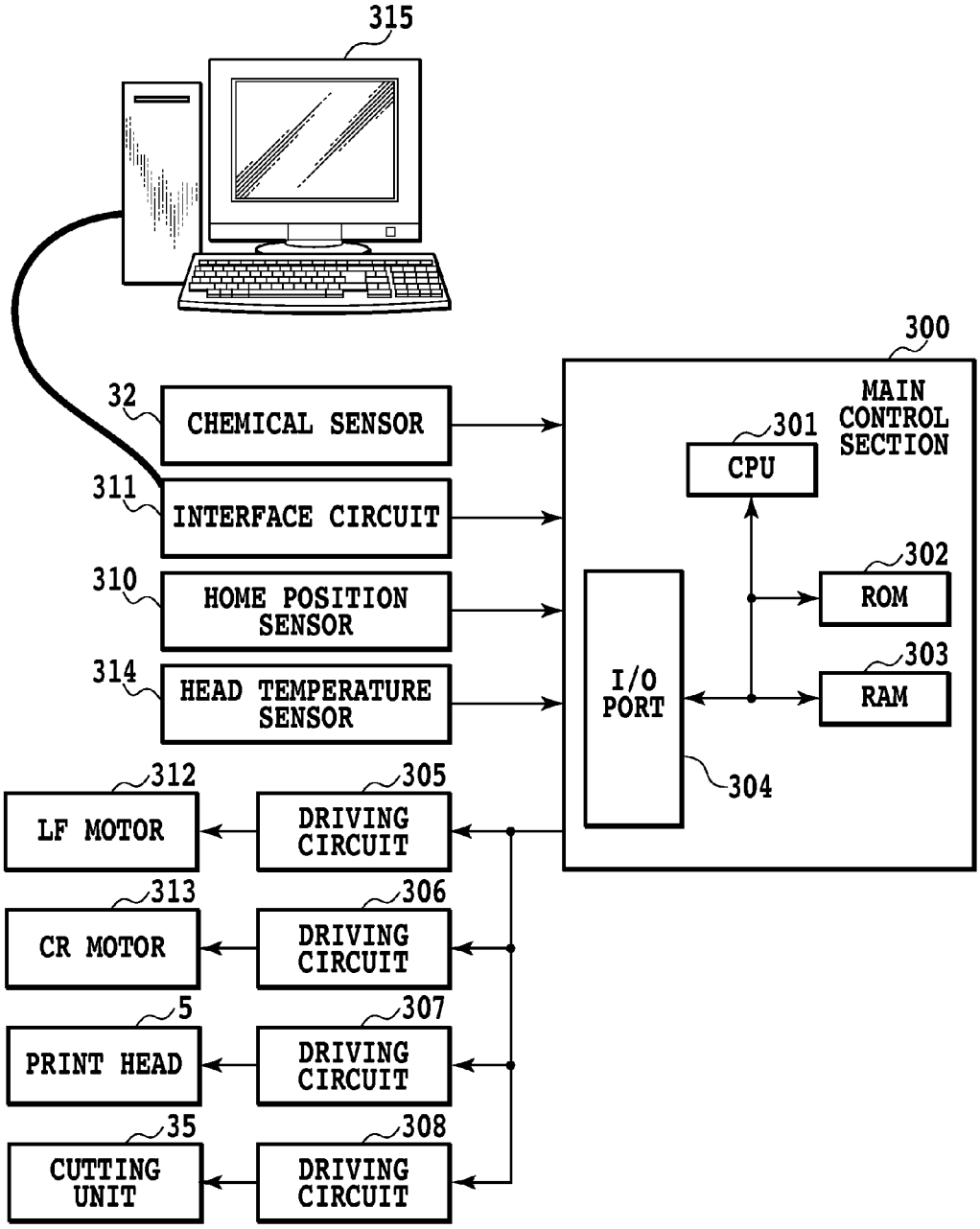
FIG. 4 is a block diagram showing a general configuration of a control system according to the present embodiment.

FIG. 4 is a block diagram showing a general configuration of a control system according to the present embodiment. A main control section 300 includes a CPU 301 that performs processing operations for calculations, control, and the like, a ROM 302 in which control programs to be executed by the CPU 301 are stored, a RAM 303 used as a buffer for print data and the like, and an I/O port 304. The I/O port 304 connects to a conveying motor (LF motor) 312, a carriage motor (CR motor) 313, and driving circuits 305, 306, 307, and 308 for actuators in the print head 5 and the cutting unit. Moreover, the I/O port 304 connects to ahead temperature sensor 314 that detects the temperature of the print head, a home position sensor 310 that detects that the carriage 1 is at a home position thereof where the carriage 1 performs a recovery operation, and other sensors. The main control section 300 is connected to a host computer 315 via an interface circuit 311.

A control operation performed by the ink jet printing apparatus configured as described above will be described.

The ink jet printing apparatus needs to keep the image quality of printing results uniform regardless of the hue or density of image data to be printed. However, the time required to dry the ink ejected onto the print medium depends on the type of the ink or the amount of ink ejected to the print medium. Furthermore, with the printing apparatus that executes the process of cutting the print medium using the cutting device during the image printing operation as in the present embodiment, the time from completion of the preceding print scan until the start of the succeeding print scan increases by the time required for the cutting process.

Thus, if the wait time between scans of the print head (hereinafter simply referred to as the wait time) is set to be constant, the hue of the print image may vary depending on the type of the ink, the amount of applied ink, and downtime for the cutting process. This may degrade image quality. For example, if image data with a high image density is printed, the amount of ink applied to the print medium increases. Thus, when the cutting process increases the wait time, the drying unevenness in the print image is significant, profoundly affecting the image (color unevenness). If image data with a low image density is printed, the amount of ink applied to the print medium decreases. Thus, the cutting operation insignificantly affects the image. However, in this case, in spite of a small amount of applied ink and a short time required for drying, a longer wait time than necessary may be set, disadvantageously reducing printing throughput.

Thus, in the present embodiment, the carriage downtime is set based on input image data. That is, if the input image data indicates a large amount of applied ink and the use of a large amount of ink with poor drying characteristics, the wait time is increased. If the input image data indicates a small amount of applied ink and the use of a large amount of ink with excellent drying characteristics, the wait time is reduced. This enables possible color unevenness or the like to be inhibited, allowing high image quality to be obtained. Furthermore, the present embodiment reduces unwanted wait time, improving the printing throughput compared to the case where a constant wait time is specified.

A control operation of the present embodiment will be specifically described with reference to a flowchart in FIG. 5.

First, in S401, the apparatus determines whether or not a user has specified the marginless printing. If the marginless printing has not been specified, a normal printing operation is performed which forms non-printing areas at the end portions of the print medium (a bordered printing operation) (S408). If the user has specified the marginless printing, the threshold value k, described below, is set based on the type of the print medium and the number of printing passes. Then, a marginless printing operation is started (S402). In the printing operation performed in this case, the ink is ejected to areas located outside the laterally opposite end portions of the print medium to reliably print an image even at the laterally opposite end portions of the print medium. Then, in S403, to make insignificant the adverse effects of the ink drying unevenness resulting from the cutting operation of the cutting unit 35, the apparatus determines whether or not a preset area (hereinafter referred to as a wait time control area) on the print medium has reached a position opposite the print head.

Figure 3:
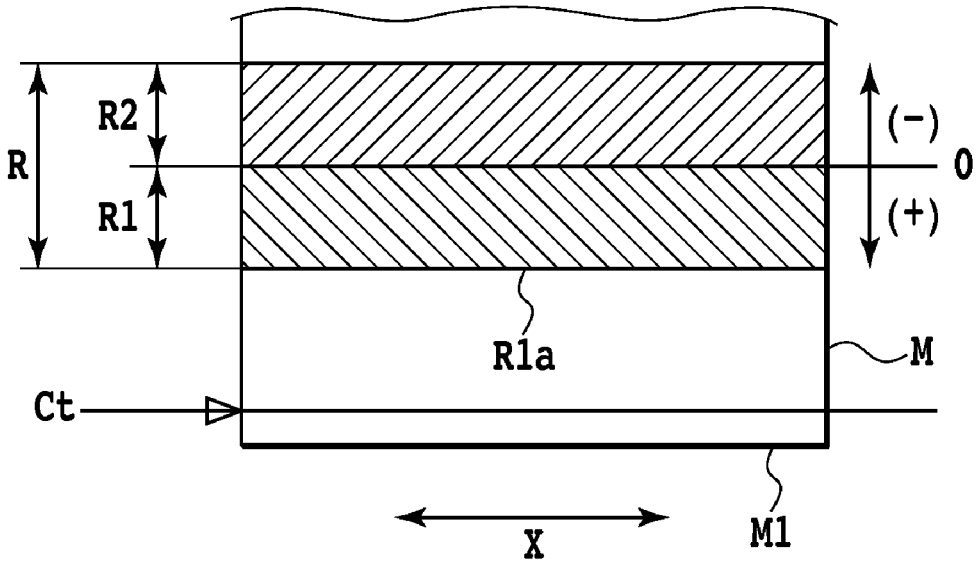
FIG. 3 is a plan view schematically showing a scan wait control area according to the present embodiment.

The wait time control area on the print medium will be described with reference to schematic diagrams in FIGS. 2 and 3.

In the present embodiment, when a leading end portion M1 of a print medium with an image printed thereon passes a cutting position Cp for the cutting unit 35 by a predetermined distance, an ink ejecting operation of the print head is stopped. Then, the knife 35*a* is projected, and the carriage is then moved in the main scanning direction (direction X) to allow the knife 35*a* of the cutting unit 35 to cut the leading end portion of the print medium. In the cutting process, a position on the print medium located opposite an axis in the main scanning direction along which the most downstream nozzles n0 (see FIG. 2) in the print head 5 move is defined as a reference position "0". Then, an area extending in the sub-scanning direction from the reference position "0" by a predetermined distance is defined as a wait time control area R (see FIG. 3). Here, the wait time control area R includes an area R1 located downstream of (a sheet discharging direction) the reference position "0" and an area R2 located upstream of the reference position "0". Each of the areas R1 and R2 has a width of 1,280 dots. In the figures, the upstream direction from the reference position "0" is denoted as minus (−). The downstream direction from the reference position "0" is denoted as plus (+). Thus, in S402, described above, the apparatus determines whether or not a part (print start area) of the downstream area R1 of the print medium M which is first printed has reached a scan area of the print head 5. That is, the apparatus determines whether or not an end portion R1*a* of the downstream area R1 has reached the most downstream nozzle reference position "0".

Upon determining in S403 that the print start area has reached the scan area of the print head 5, the apparatus executes, in S404, a dot count process of counting the number of dots printed in each of predetermined determination areas into which the wait time control area R is divided. The dot count process will be described below in the "Dot Count Process" section. Thereafter, in S405, the apparatus determines whether or not a threshold value preset in view of the maximum amount of ink that can be ejected into the print medium is exceeded by a correction count value obtained by multiplying the dot count value resulting from the dot count process by a weighting factor specified according to the type of the ink (the drying characteristics of the ink). The determination is performed on all the determination areas included in the wait time control area R. Then, for each of determination areas included in each band, the number of times α that the correction count value exceeds the threshold value is counted.

Then, based on the result (the number of times α) of the determining process in S 405, described above, the apparatus selects the time (wait time) from completion of a print scan of the preceding scan area for which the determining process has been executed until the succeeding print scan is started (S406). After the wait time is thus selected, the print scan of the preceding scan area is performed. After the print scan, when the wait time elapses, a printing operation on the next scan area is started.

A method of setting the wait time in the ink jet printing apparatus according to the above-described embodiment will be specifically described below.

(Dot Count Process)

First, a specific example of the dot count process executed in S404, described above, will be described.

Figure 6:
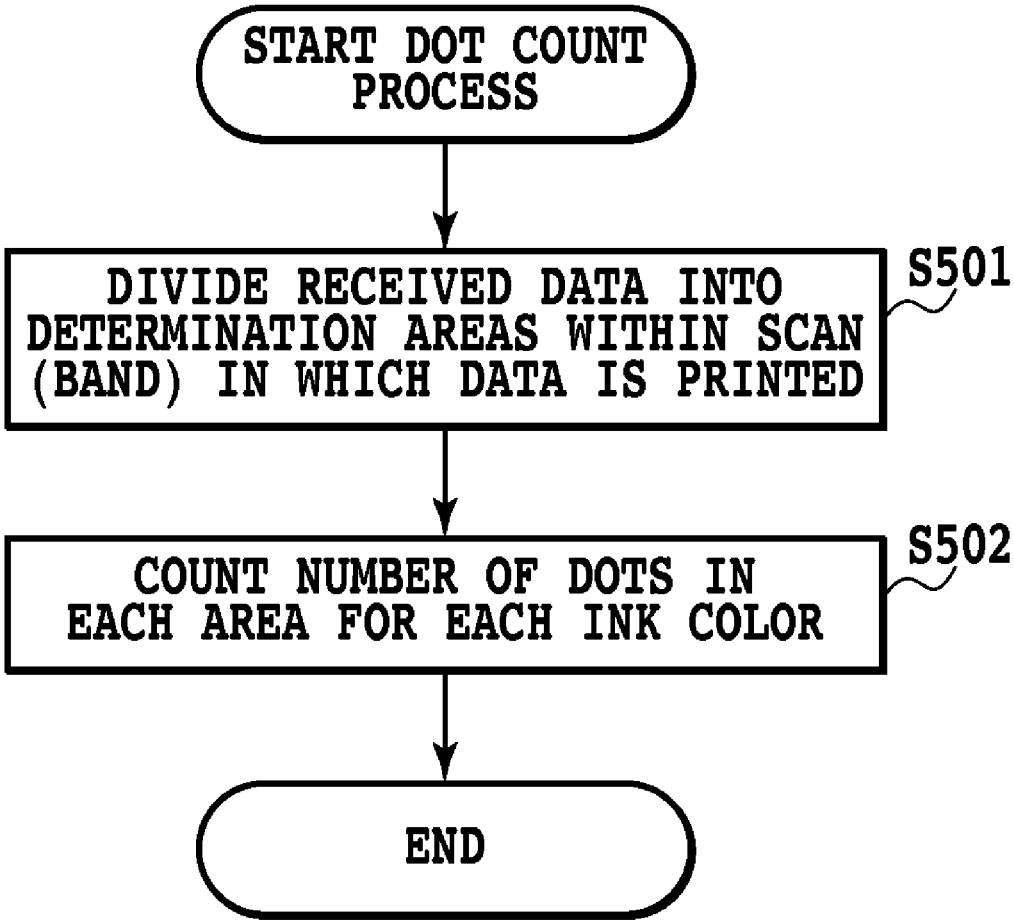
FIG. 6 is a flowchart showing a procedure of a dot count process executed according to the present embodiment.

FIG. 6 is a flowchart showing a procedure of the dot count process executed in the present embodiment. In FIG. 6, in S501, received image data for one band is divided into the determination areas each of a predetermined size. In the present embodiment, dots are formed at a density of 1,200 dpi both in a vertical direction (sub-scanning direction) and in a horizontal direction (main scanning direction). The size of each of the determination areas is 128×128 dots. However, the size of the determination area can be set to any value in view of the width of active nozzles in the print head. For multipass printing, the width corresponding to the active nozzle width may be divided by the number of the passes.

Then, in S502, the number of dots for each ink color (the number of ink droplets) to be printed in each determination area is independently counted based on the print data. The count process is executed on the entire wait time control area R. The count value is corrected by multiplying the count value corresponding to each ink type (each ink color) by the weighting factor set for the ink type.

(Setting the Weighting Factor for Each Ink Color)

Now, description will be given of a method of setting the weighting factor by which the dot count value for each ink color obtained by the dot count process is multiplied. The weighting factor is set according to the drying characteristics of each ink color; the setting method is as described below. In an example described below, glossy paper is used as the print medium to which the ink is applied.

Figure 5:
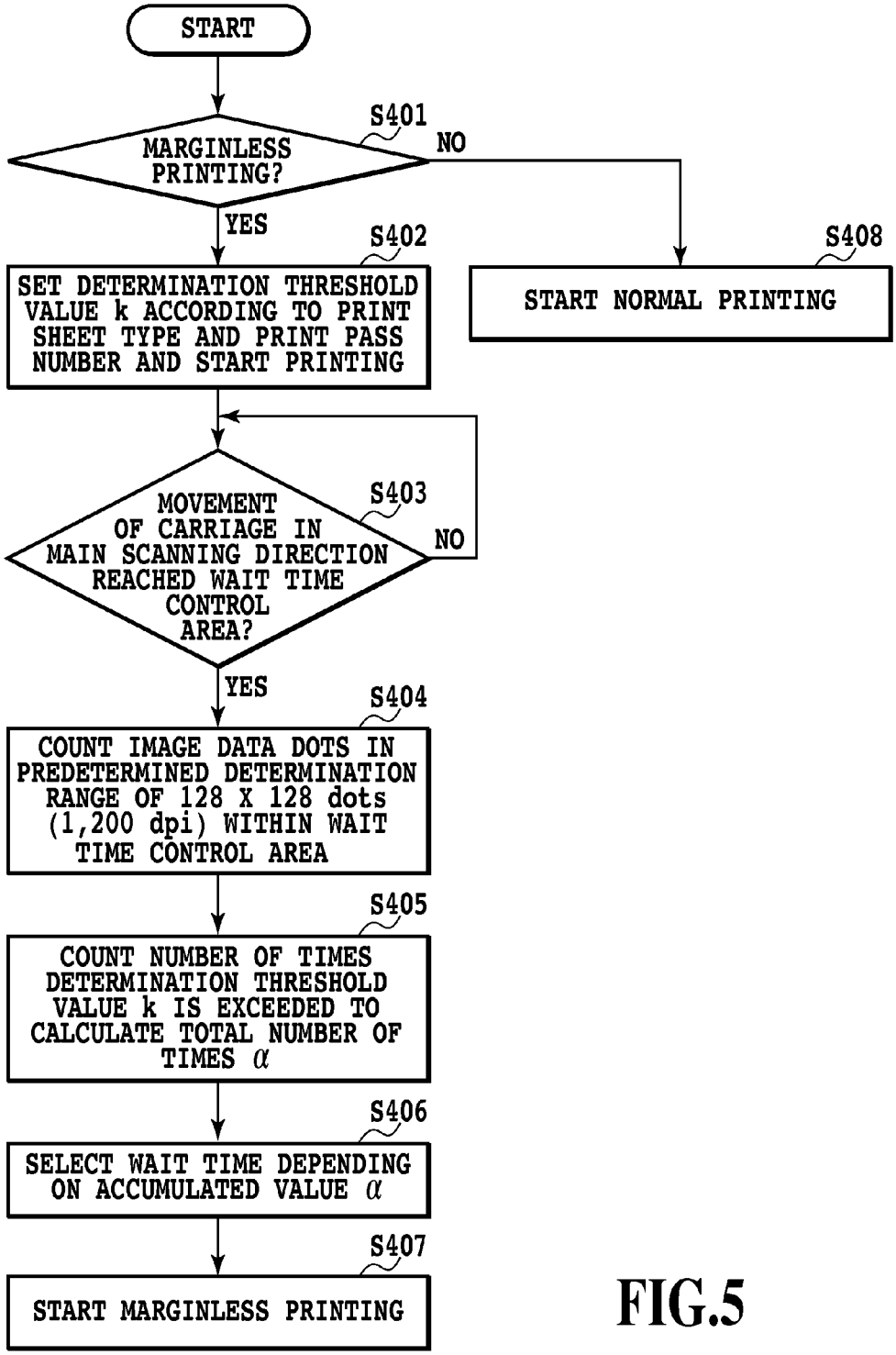
FIG. 5 is a flowchart showing a control operation according to the present embodiment.
Figure 7:
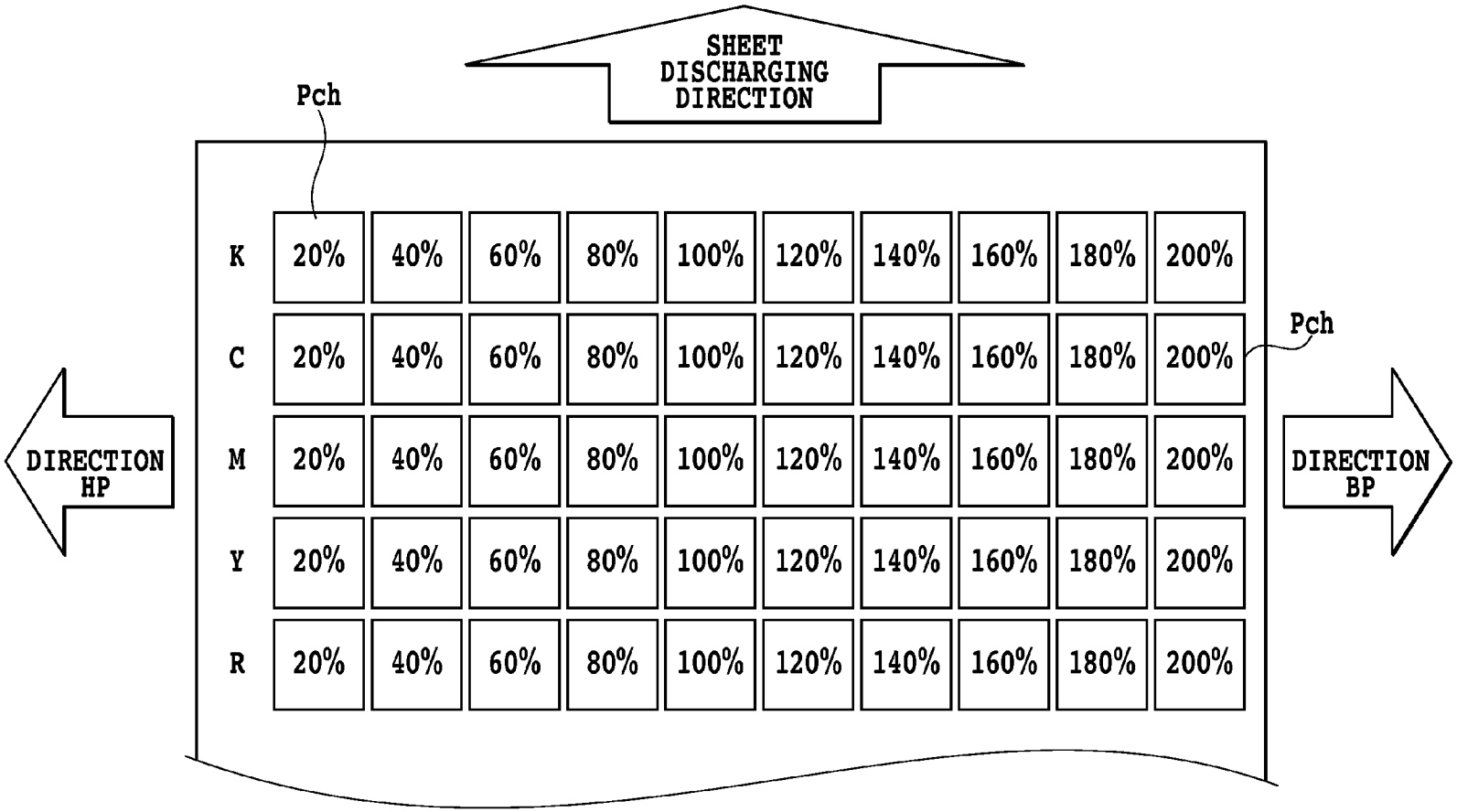
FIG. 7 is a schematic diagram of an image used for evaluation.

First, a plurality of evaluation patches Pch as shown in FIG. 5 were printed for each ink color used for the printing apparatus according to the present embodiment. During printing of the evaluation patches Pch, the carriage 1 was stopped for 3 sec between scans. Then, the level of the adverse effect (printing unevenness) of the drying unevenness of the patches in each ink color on the image was evaluated. For the patches shown in FIG. 7, a condition in which dots were arranged all over a dot formation area of 128×128 dots (1,200 dpi) was defined as 100%, and duty was increased at 20% increments. The arranged patches were at 10 levels from a minimum of 20% to a maximum of 200%.

For the inks used for the printing apparatus, even with the printing conditions such as the amount of applied ink and the wait time remaining unchanged, the condition of the printing unevenness observed in the image varies depending on the capability of permeating the print medium, the drying characteristics, and the optical density of the ink.

Thus, the condition of the printing unevenness observed in the image was evaluated based on the following reference.

○: Acceptable image quality with insignificant ink drying unevenness (market demands are met)

Δ: Ink drying unevenness is observed.

x: Ink drying unevenness is observed all over image.

The results of the evaluation of the condition of the observed printing unevenness are as shown in FIG. 9.

The results indicated that C, M, B, and G inks were likely to cause printing unevenness and that Y and R inks were unsusceptible to drying unevenness. Based on this, the weighting factors for the respective ink colors were set to values shown in FIG. 8A.

The dot count value of each ink color determined for each determination area was multiplied by the weighting factor set for the ink color. Then, for each ink color, a corrected count value (corrected ink droplet number) was determined for each determination area. Then, for each determination area, the sum N of the corrected count values for the respective ink colors is determined. The sum N is compared with a preset threshold value to determine whether or not the sum N exceeds the threshold value.

The weighting factor for each ink type may be stored in the ROM 302, mounted in the printing apparatus. Alternatively, the printing apparatus may include a function of enabling the above-described patch pattern to be printed in response to the user's instruction, to allow default weighting factors to be changed.

Now, setting of the threshold value will be described. In the present embodiment, the threshold value is determined by the printing apparatus main body based on the maximum amount of ink ejected into the print medium used and the number of passes required to print the appropriate image in one print area. FIG. 8B shows an example of a threshold value setting table stored in the printing apparatus main body. In the illustrated table, the number of dots corresponding to the threshold value k is set for each of plural types of printing pass numbers (6, 12, and 16 passes). That is, the threshold value k is set to 4,200 dots for the 6 passes, 2,400 dots for the 12 passes, and 1,800 dots for the 16 passes. The threshold value k as shown herein is set on the assumption that glossy paper is used as the print medium.

(Setting of the Wait Time)

Now, the wait time set for the printing operation on the wait time control area will be described. In the present embodiment, as described above, the dot count value for each ink color is determined for each of the determination areas within the wait time control area R. The dot count value for each ink color is then multiplied by the weighting factor set for the ink color to obtain the corrected dot count value for the ink color. Then, for each determination area, the sum N of the corrected dot count values for the respective ink colors is determined. The apparatus then determines whether or not the sum N exceeds the threshold value, and counts the number of times that the sum N exceeds the threshold value. That is, every time the sum N for the determination area exceeds the threshold value k shown in FIG. 8B, 1 is added to the number of times $\alpha$. This counting is performed on all the determination areas within the wait time control area. Then, depending on the value of the final count $\alpha$, the wait time is set as described below.

Figure 11:
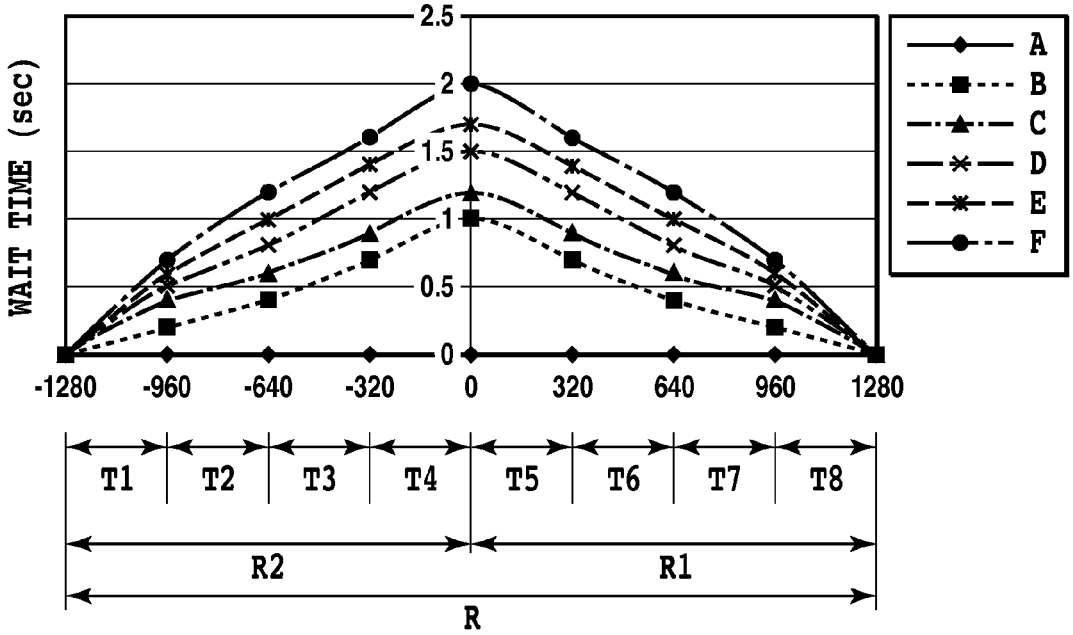
FIG. 11 is a diagram showing the relationship between the number of times $\alpha$ that the sum for each determination area within the wait time control area exceeds the threshold value k and the wait time set depending on the number of times $\alpha$.

FIGS. 10 and 11 show a relationship between the number of times $\alpha$ that the sum N for each of the determination areas within the wait time control area exceeds the threshold value k and the wait time set depending on the number of times $\alpha$. In the present embodiment, as shown in FIGS. 10 and 11, the wait time control area R is divided into eight areas T1 to T8. The areas T1 to T4 are positioned upstream of the reference position 0 in the conveying direction (sub-scanning direction) of the print medium. The areas T5 to T8 are positioned downstream of the reference position 0 in the conveying direction. Each of the areas T1 to T8 has a width equal to 320 dots. For example, the area T1 means an area from a position located 960 dots upstream of the reference position 0 (−960 dot position) to a position located 1,280 dots upstream of the reference position 0. The area T5 means an area from the reference position 0 to a position located 320 dots downstream of the reference position 0. A plurality of scans are performed within each area. The same wait time is set between the plurality of scans performed within the same area. In this case, two scans are performed in each of the areas T1 to T8. The wait time set between the two scans is as described in a "Standby Time Setting Pattern" section in FIG. 10. For example, with a pattern B in the "Standby Time Setting Pattern" section, a wait time of 0.2 sec is set for the area T1 (−1,280 dots to −960 dots) and the area T8 (1280 dots to 960 dots). Furthermore, a wait time of 0.4 sec is set for the area T2 (−960 dots to −640 dots) and the area T7 (960 dots to 640 dots).

In the present embodiment, as shown in FIG. 10, the wait time is varied step by step for the areas T1 to T8. That is, the longest wait time is set for the area T4, with the wait time reduced in decrements of a given time (0.2 sec) for the preceding and succeeding areas. Switching positions shown in FIGS. 10 and 11 indicate positions where the wait time is switched step by step.

Furthermore, the present embodiment uses six types of patterns A, B, C, D, E, and F as wait time setting patterns. For the setting pattern A, the wait time is not set for any of the wait time control areas. The wait time for the setting pattern is increased in the order of B, C, D, E, and F. One of the setting patterns A, B, C, D, E, and F which corresponds to the number of times $\alpha$ that the above-described threshold value k is exceeded is selected according to a selection table shown in FIG. 12. The selected setting pattern is then reflected in the printing operation. That is, for a larger number of times $\alpha$, the image data is more likely to cause drying unevenness. The wait time is thus set to be longer. For example, if image data for which the number of times $\alpha$ is at least 301 and which is thus unlikely to dry is used in printing, the wait time until the start of the next scan is set according to the setting pattern F. On the other hand, if image data for which the number of times a is 101 to 150 or more and which is thus relatively unlikely to cause drying unevenness is to be printed, the wait time until the start of the next scan is set according to the setting pattern B.

With the wait time set in association with the image data to be printed as described above, the printing operation was actually performed according to a flowchart shown in FIG. 5. As a result, the printing unevenness occurring during the cutting operation in association with the image data was reduced. Moreover, as a result of a reduction in excessively long wait scan time, the present printing apparatus reduced the time required for the printing operation compared to the conventional printing apparatus, for which the constant wait scan time is set.

The threshold values k in FIG. 8B are set on the assumption of the use of only glossy paper. However, of course, the threshold value k is desirably set for each print medium type such as matte paper or plain paper. For example, the plain paper requires a longer time to dry the ink than the glossy paper. Thus, the threshold value k is set to be smaller for the plain paper than for the glossy paper. Then, for the plain paper, the dot count result is likely to exceed the threshold value k, and the wait time is generally longer than that for the glossy paper. Consequently, the appropriate wait time is set for the plain paper.

Moreover, the present printing apparatus prevents the possible disadvantageous printing unevenness during the process of cutting the trailing end portion of the print medium. This is because a portion of the print medium in which the printing unevenness may result from the process of cutting the trailing end portion is cut off from the print medium. That is, executing the above-described waiting process for the process of cutting the trailing end simply reduces the throughput. Thus, the above-described waiting process is desirably executed only for the process of cutting the leading end portion. Furthermore, if a plurality of pages are consecutively subjected to marginless printing, the above-described waiting process may be executed exclusively for the process of cutting the leading end portion provided that printing of the succeeding page is started after the process of cutting the trailing end portion of the preceding page is completed.

However, when a plurality of pages are consecutively subjected to marginless printing, if printing of the succeeding page is already started when the trailing end portion of the preceding page is cut, the process of cutting the trailing end portion of the preceding page may affect the printing unevenness in the succeeding page. Thus, with the printing apparatus with this configuration, the above-described waiting process is suitably executed for both processes of cutting the leading and trailing end portions.

The present invention is not limited to the above-described embodiment, which may be modified as described below.

The above-described embodiment reduces the possible printing unevenness during cutting of the leading end portion of the print medium for marginless printing. However, the setting of the wait time according to the above-described embodiment is also applicable to, instead of the process of cutting the print medium during the printing operation, a process of providing a halt time for the printing operation. For example, the setting of the wait time is also applicable to a printing apparatus that executes a process of folding the leading end portion, suction recovery process or the like. That is, the processes of folding the leading end portion, recovery process or the like may be executed between the adjacent scans of the printings. Accordingly, any process requires relatively long halt time for a printing operation. If this process is executed, the wait time for the process may be longer than the other wait times, and the printing unevenness may occur in the image. Thus, if a process other than the cutting process is executed during the scanning, the possible printing unevenness in the image can be reduced by setting the wait time as is the case with the above-described embodiment. That is, the wait time is set according to the image data, and the wait time set between the scans of the preceding and succeeding areas for the process of halting the printing operation is varied step by step as is the case with the above-described embodiment. This enables the possible printing unevenness to be reduced as is the case with the above-described embodiment.

The present invention is also applicable to a printing apparatus that does not execute any process requiring halting of the printing operation as described above. That is, if a large amount of ink is applied to the print medium or the ink used is difficult to dry, the conventional printing apparatus needs to significantly change the wait time based on the image data. However, with the printing apparatus to which the present invention is applied, the wait time is set according to the image data. Thus, the printing operation can be performed during each scan with a given dry condition maintained, providing high-quality images.

Furthermore, in the above-described embodiment, the position where printing is performed during the cutting process is defined as the reference position, and the predetermined wait time control area is set on each of the upstream and downstream sides of the reference position. Then, the wait time is controlled only for the wait time control areas. However, the wait time may be controlled all over the print medium based on the image data.

Additionally, according to the present embodiment, the wait time control area R is divided into the determination areas, and the apparatus determines whether or not the corrected count value for each of the determination areas exceeds the threshold value. One of the setting patterns A to F for the wait time is then selected based on the number of times a that the corrected count value exceeds the threshold value. However, the apparatus may determine whether or not the corrected count value for the determination area contained in each scan area exceeds the threshold value to set the wait time for the scan area based on the number of times a that the corrected count value exceeds the threshold value.

Furthermore, in the above-described embodiment, the same print area is printed through 6, 12, or 16 passes by way of example. However, the present invention is not limited to this aspect and is applicable to n-pass printing in which an image is completed through n (n>0) scans.

Additionally, in the above-described embodiment, the conveying direction of the print medium and the main scanning direction of the print head cross at right angles by way of example. However, the conveying direction and the main scanning direction need not necessarily cross at right angles but may cross at different angles.

In the present embodiment, the "printing" is not limited to formation of meaningful information such as texts and figures, but includes formation of images, patterns, or the like on the print medium, and processing of the print medium.

The "print medium" includes not only paper, which is used for common printing apparatuses, but also articles such as plastic films, metal plates, glass, ceramics, woods, and leather which can receive ink.

The "ink" is to be broadly interpreted as is the case with the definition of the "printing". That is, the "ink" used in the present embodiment refers to a liquid that is applied to a print medium to form images, patterns, or the like or to process the print medium or to treat the ink (for example, to solidify or insolubilize a coloring agent in the ink applied to the print medium).

The "nozzle" refers to the ejection port, or collectively refers to a liquid channel communicating with the ejection port and an element generating energy utilized to eject ink, unless otherwise specified.

Furthermore, the present invention discloses the method of ejecting the ink using the electrothermal conversion element but may adopt a method of ejecting the ink using an electromechanical conversion element such as a piezo element.

Furthermore, in the present embodiment, the width dimension of the print medium is detected using the optical sensor, and the detection data is input to the CPU as controller. However, the width dimension of the print medium may be pre-input to the CPU by the user via input unit.

Additionally, the ink jet printing apparatus according to the present invention may be an image output terminal for information processing equipment such as a computer which terminal is provided integrally with or separately from the computer, or may take the form of a copier combined with a reader or the like or a facsimile machine offering a transmitting and receiving function.

The present invention may also be implemented by supplying a software program realizing the functions and processes of the above-described embodiment, directly or remotely to a system or an apparatus so that a computer in the system or apparatus reads a code from the supplied program for execution. In this case, the program code installed in the computer implements the present invention in order to allow the computer to realize the functions and processes of the present invention. Furthermore, the program installed in the computer has only to realize the functions and processes of the present invention and may be in any form; the program may be an object code, a program to be executed by an interpreter, or script data to be supplied to an OS.

The print medium via which the program is supplied may be, for example, a flexible disc, a hard disc, an optical disc, a magneto-optic disc, an MO, a CD-ROM, a CD-R, a CD-RW, or a magnetic tape. Other examples of the print medium via which the program is supplied include a nonvolatile memory card, a ROM, and a DVD (DVD-ROM or DVD-R).

Alternatively, the method of supplying the program may be implemented by using a browser in a client computer to connect to the Internet to download, from the appropriate homepage, the program of the present invention or a file in which the program is compressed and which offers an automatic installation function. Alternatively, the method may be implemented by dividing the program code making up the program of the present invention into a plurality of files and downloading the respective files from different homepages. That is, the scope of the present invention embraces a WWW server from which a plurality of users can download the program file allowing the computer to realize the functions and processes of the present invention.

Furthermore, the program of the present invention may be enciphered, and the enciphered program may be stored in a storage medium, which is then distributed to users so that users clearing predetermined conditions can download key information required for deciphering from the appropriate homepage and then use the key information to execute and install the enciphered program.

The functions of the above-described embodiment can be realized by, instead of allowing the computer to execute the read program, allowing an OS running on the computer to execute a part or all of the actual process using the program.

Alternatively, the functions of the above-described embodiment can be realized by writing the program read from the recording medium to a memory in an expanded board inserted into the computer or an expanded unit connected to the computer so that the CPU can execute a part or all of the process using the program.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-298426, filed Nov. 16, 2007, which is hereby incorporated by reference herein in its entirety.

What is claimed is:

1. An ink jet printing apparatus allowing a print head that ejects an ink droplet based on print data, to scan the same area of a print medium a plurality of times to print an image on the print medium, the apparatus comprising:

a controller that controls a wait time set between a preceding scan and a succeeding scan in a plurality of scans performed by the print head on a predetermined area, wherein the controller controls the wait time; and a counter that counts a number of ink droplets ejected to the predetermined area based on print data on the predetermined area, wherein the controller controls the wait time based on a result of counting by the counter, wherein the counter determines a number of ink droplets ejected to each of a plurality of determination areas into which the predetermined area is divided, and wherein the controller controls the wait time according to a number of times that the number of ink droplets ejected to the determination area exceeds a threshold value.

2. The ink jet printing apparatus according to claim 1, wherein the print head ejects ink droplets of a plurality of ink types, and the counter counts the number of ink droplets for each of the ink types ejected to the determination area, and the controller controls the wait time based on the number of times that a sum of the ink droplet numbers for the plurality of types of inks exceeds a threshold value.

3. The ink jet printing apparatus according to claim 2, wherein the counter determines corrected number of the ink droplets for each of the ink types ejected to the determination area based on the number of the ink droplets and a factor specified for each of the ink type, and the controller controls the wait time based on the number of times that a sum of the corrected ink droplet numbers for the plurality of types of inks exceeds a threshold value.

4. The ink jet printing apparatus according to claim 2, wherein a halt time during which a predetermined process is executed is contained in the wait time set between a predetermined scan and a succeeding scan in a plurality of scans performed by the print head on the predetermined area.

5. The ink jet printing apparatus according to claim 4, wherein the controller sets one of the wait times set between the scans performed on the predetermined area which contains the halt time for the predetermined process, to be a longest wait time, and the controller sets at least one of the wait times preceding and succeeding the wait time containing the halt time, to a value obtained by reducing a value of the longest wait time step by step.

6. The ink jet printing apparatus according to claim 4, wherein the controller sets one of the wait times set between the scans performed on the predetermined area which contains the halt time for the predetermined process, to be the longest wait time, and the controller sets a plurality of the wait times preceding and succeeding the wait time containing the halt time, to values obtained by reducing the value of the longest wait time step by step.

7. The ink jet printing apparatus according to claim 4, wherein the predetermined process is a cutting process of cutting an end portion of the print medium for a marginless printing operation of performing printing without forming a non-printing area at end portions of the print medium.

8. The ink jet printing apparatus according to claim 4, wherein the predetermined process is a recovery process of recovering an ink droplet ejecting capability of the print head.

9. An ink jet printing method of allowing a print head that ejects an ink droplet based on print data, to scan the same area of a print medium a plurality of times to print an image on the print medium, the method comprising:

controlling a wait time set between a preceding scan and a succeeding scan in a plurality of scans performed by the print head on a predetermined area; and counting the number of ink droplets ejected to the predetermined area based on print data on the predetermined area, wherein the wait time is based on a result of the counting, wherein the counting determines a number of ink droplets ejected to each of a plurality of determination areas into which the predetermined area is divided, and wherein the wait time is based on the number of times that the number of ink droplets ejected to the determination area exceeds a threshold value.

* * * * *